United States Patent [19]

Noda

[11] 4,273,457

[45] Jun. 16, 1981

[54] RECORDING DEVICE FOR USE WITH RECORDING MEDIA OF VARIOUS WIDTHS

[75] Inventor: Atsushi Noda, Yokohama, Japan

[73] Assignee: Canon Kabushiki Kaisha, Tokyo, Japan

[21] Appl. No.: 71,729

[22] Filed: Aug. 31, 1979

Related U.S. Application Data

[63] Continuation of Ser. No. 843,166, Oct. 17, 1977, abandoned.

[30] Foreign Application Priority Data

Nov. 16, 1976 [JP] Japan ..... 51/137541

[51] Int. Cl.[3] ..... B41J 29/42

[52] U.S. Cl. ..... 400/705.1; 400/315; 400/320; 400/344; 400/350; 400/633.2

[58] Field of Search ..... 400/119, 120, 124, 126, 400/315, 320, 343, 344, 350, 613, 615, 633, 633.1, 633.2, 671, 705.1; 346/136; 226/199; 200/61.04, 275; 250/208

[56] References Cited

U.S. PATENT DOCUMENTS

| | | | |
|---|---|---|---|
| 3,322,253 | 5/1967 | Burns et al. | 400/124 |
| 3,557,327 | 1/1971 | Lepp et al. | 200/61.04 |
| 3,584,173 | 6/1971 | Launt et al. | 200/275 |
| 3,648,050 | 3/1972 | Koo | 250/208 |
| 3,651,914 | 3/1972 | Locke | 400/344 X |
| 3,893,558 | 7/1975 | Fulton et al. | 400/124 |
| 3,988,744 | 10/1976 | Noda | 400/633.2 X |
| 4,044,882 | 8/1977 | Weinke et al. | 400/320 X |

FOREIGN PATENT DOCUMENTS

| | | | |
|---|---|---|---|
| 2528446 | 2/1976 | Fed. Rep. of Germany | 400/124 |

*Primary Examiner*—Ernest T. Wright, Jr.

*Attorney, Agent, or Firm*—Fitzpatrick, Cella, Harper & Scinto

[57] ABSTRACT

A recording device is disclosed according to which writing information is recorded and the writing position in which the record head writes the information on a recording medium is detected. A discriminator determines the width of the recording medium loaded in the device, and a controller responsive to the discriminator and the detector controls the movement of the record head.

7 Claims, 5 Drawing Figures

RECORDING DEVICE FOR USE WITH RECORDING MEDIA OF VARIOUS WIDTHS

This is a continuation, of application Ser. No. 843,166, filed Oct. 17, 1977, now abandoned.

BACKGROUND OF THE INVENTION

1. Field of the Invention

This invention relates to a recording device with which paper webs of various widths may be used.

2. Description of the Prior Art

These years have seen increasing need for recording paper webs of various widths to be used in compliance with various usages which have resulted from the diversified types of information, whereas printers such as relatively small recording devices heretofore used have limited the width of available recording paper web to only one size and so, different printers had to be chosen for use in compliance with the various usages.

As a solution to this problem, it would occur to mind to provide a paper guide 2 movable widthwise of recording paper 1 and to provide means for moving the paper guide 2 in accordance with the width of the paper 1 to control the recording paper 1, as shown in FIG. 1 of the accompanying drawing.

In conventional printers, however, limit switches 4 and 4' are fixedly disposed at the opposite extremities of the stroke of a printing head 3 for the detection of the home position of the printing head 3 and for the detection of the maximum number of print columns and, when recording paper 1 of narrow width is used, the presence of these fixed limit switches 4 and 4' gives rise to an event that the printing head 3 moves beyond the width of the paper 1.

This offers a problem particularly in the case of printers such as thermosensitive print systems, discharge breakdown print systems or the like in which the printing head keeps contact with recording paper during non-printing mode.

SUMMARY OF THE INVENTION

It is an object of the present invention to provide a recording device improved in the above-noted points.

It is another object of the present invention to provide a recording device in which the amount of information written is controlled by means for determining the width of the recording medium and means for detecting the movement of the record head.

Other objects of the present invention will become apparent from the following detailed description of an embodiment of the invention taken in conjunction with the accompanying drawing.

DESCRIPTION OF THE PREFERRED EMBODIMENTS

Figure 1:
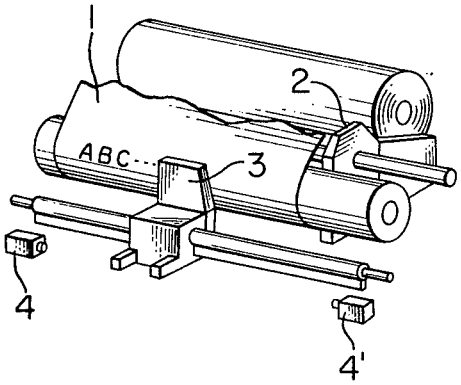
FIG. 1 PRIOR ART
FIG. 1 is a perspective view of a printer according to the prior art.
Figure 2:
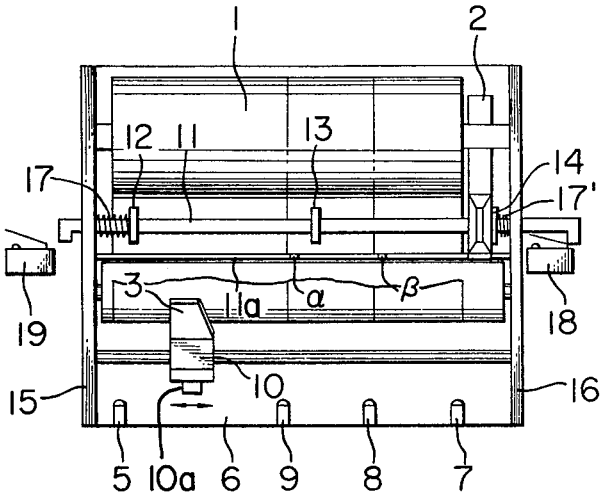
FIG. 2 shows the construction of an embodiment of the present invention.

Referring to FIG. 2, it shows a printer as the recording device of the present invention with which recording paper webs of three different widths are usable. A zero position detector 5 for detecting the home position of the printing head 3 is fixed to the main body 6 of the printer. A first detector 7, a second detector 8 and a third detector 9 for detecting the movement of a carriage 10 to which the printing head 3 is attached are affixed to the main body 6 to detect the maximum numbers of print columns corresponding to the three sizes of paper width. The carriage 10 is provided with a light emitting means, a magnet 10*a*, etc. for the detection of movement. The zero position detector 5 may be either a contact type switch such as a spring contact, microswitch or the like, or a non-contact type switch such as a photocoupler (U.S. Pat. No. 3,648,050), reed switch, (U.S. Pat. No. 3,584,173 or No. 3,557,327) Hall element or the like. On the other hand, the first to third detectors 7–9 may preferably be the above-mentioned non-contact type switches so that they may not interfere with the movement of the carriage 10 to which the printing head 3 is attached.

A guide shaft 11 is mounted on the main body 6 with a degree of axial freedom, and the paper guide 2 is slidable on the guide shaft 11. Projections 12, 13 and 14 are secured to the guide shaft 11 at three locations thereon, and compression coil springs 17 and 17' are mounted coaxially with the guide shaft 11 between the projection 12 and a left plate 15 and between the projection 14 and a right plate 16, respectively.

Another guide shaft 11*a* extends parallel to the guide shaft 11 and has the opposite ends thereof secured to the left plate 15 and the right plate 16. The paper guide 2 is mounted slidably also on the guide shaft 11*a* and designed for engagement with grooves $\alpha$, $\beta$ and $\gamma$ formed in the guide shaft 11*a*. Such engagement is accomplished as by balls (not shown, see U.S. Pat. No. 3,988,744) provided in the paper guide 2 being projected into the grooves $\alpha$, $\beta$ and $\gamma$ to fix the paper guide 2 with respect to the guide shaft 11*a*. Such grooves $\alpha$, $\beta$ and $\gamma$ may suitably be formed in accordance with the various widths of recording paper.

A first switch 18 and a second switch 19 are provided adjacent to the opposite ends of the guide shaft 11 and arranged to be opened and closed by axial movement of the guide shaft 11. Microswitches 18 and 19 are best suited as these switches.

Figure 3:
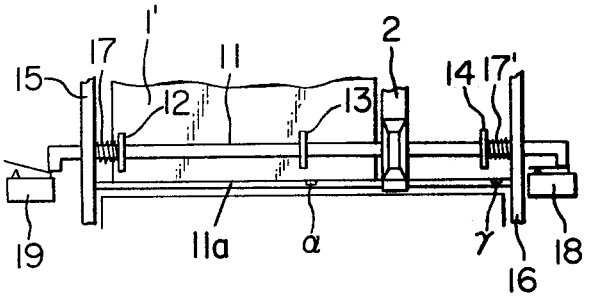
FIG. 3 illustrates a case where a web of recording paper narrower in width than that in FIG. 2 is used.
Figure 4:
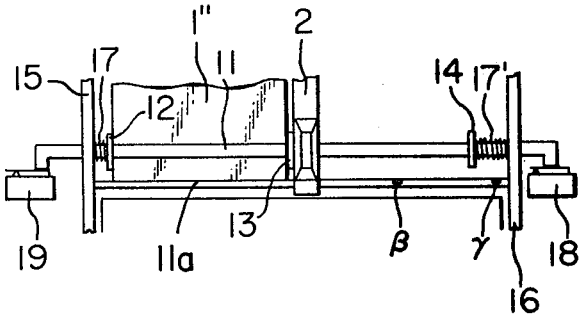
FIG. 4 illustrates a case where a web of recording paper narrower in width than that in FIG. 3 is used.

In FIG. 2 which refers to the case where recording paper 1 of the largest width (hereinafter referred to as the first recording paper) is mounted, the paper guide 2 forces the projection 14 rightwardly to the compression coil spring 17'. The guide shaft 11 integral with the projection 14 is also moved rightwardly, so that both the first and second switches 18 and 19 are not in contact with the guide shaft 11, thus bringing about OFF position.

Where recording paper 1' of medium width (hereinafter referred to as the second recording paper) is mounted, the paper guide 2 releases the compression of the compression coil spring 17', as shown in FIG. 3, so that the guide shaft 11 assumes a position determined by the actions of the compression springs 17 and 17'. At this time, the first switch 18 is in ON position while being contacted by the guide shaft 11 and the second switch 19 is in OFF position.

Where recording paper 1'' of the narrowest width (hereinafter referred to as the third recording paper) is mounted, the paper guide 2 forces the projection 13 leftwardly, as shown in FIG. 4, thus compressing the compression coil spring 17. The guide shaft 11 integral with the projection 13 is also moved leftwardly, so that both the first and second switches 18 and 19 assume ON position.

Figure 5:
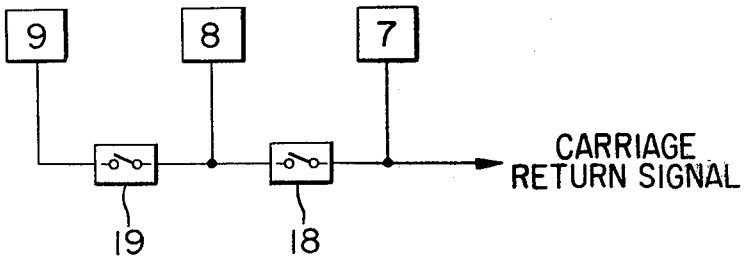
FIG. 5 is a signal block diagram of the embodiment of FIG. 2.

Finally, the output signals from the first detector 7, the second detector 8 and the third detector 9 are made to provide a carriage return signal for the printing head 3 by the wiring through the first and second switches 18 and 19, in the manner as shown in FIG. 5.

With the above-described construction, where the first recording paper 1 is loaded, both the first and second switches 18 and 19 are in OFF position so that the output signal from the first detector 7 provides a carriage return signal. Where the second recording paper 1' is loaded, the first switch 18 is in ON position while the second switch 19 is in OFF position, so that the output signal from the first and second detectors 7 and 8 provide a carriage return signal.

Where the third recording paper 1' is loaded, both the first and second switches 18 and 19 are in ON position, so that the output signals from the first, second and third detectors 7, 8 and 9 provide a carriage return signal.

An activated detector 7, 8 or 9 located nearest the home positon is first to act in accordance with a respective paper width, whereby the maximum number of print columns may be controlled for a respective paper width.

Thus, adoption of the present invention can provide a recording device which permits selective use of recording paper webs of various widths in accordance with the intended usage.

I claim:

1. A recording device comprising:

(a) recording means for writing information on a recording medium; and (b) logic control means including a plurality of first detecting means for detecting the width of the recording medium loaded in said recording device, said plurality of first detecting means including switching means actuable in response to the loading of the recording medium, second detecting means for detecting the position of the recording means in accordance with the width of the recording medium loaded in said recording device, said logic control means being responsive to said first detecting means and said second detecting means to generate a signal for controlling said recording means in accordance with the width of the recording medium loaded in said recording device.

2. A recording device according to claim 1, wherein said control means generates a signal for detecting a writing position in which said recording means writes information on said recording medium at a writing start position.

3. A recording device according to claim 1, wherein said second detecting means includes a plurality of detecting elements which are arranged in correspondence with the width of the recording medium.

4. A recording device according to claim 3, wherein said plurality of detecting elements detect movement of said recording means and generate a respective detection signal.

5. A recording device according to claim 1, further comprising means for setting the recording medium in the device, wherein said first detecting means is operable in response to said setting means, when said recording medium is loaded.

6. A recording device comprising:

recording means for writing information on a loaded recording medium;

a guide movable in accordance with a width of a loaded recording medium;

control means including means for detecting a writing position in which said recording means writes said information on the recording medium; and switching means for determining the width of said recording medium loaded in said device, said switching means having a plurality of detectors responsive to said guide, said detectors generating a plurality of signals corresponding respectively to the width of the selected recording medium, said control means being responsive to said detecting means and said switching means, for generating a signal for controlling said recording means.

7. A recording device according to claim 6, wherein said detecting means comprises a plurality of detecting elements arranged along a trace of movement of said recording means, said plurality of detecting elements being arranged in correspondence with the width of the recording medium.

* * * * *

UNITED STATES PATENT AND TRADEMARK OFFICE

CERTIFICATE OF CORRECTION

PATENT NO. : 4,273,457

DATED : June 16, 1981

INVENTOR(S) : ATSUSHI NODA

It is certified that error appears in the above—identified patent and that said Letters Patent is hereby corrected as shown below:

In the headnote, item [63], "Continuation of Ser. No. 843,166, Oct. 17, 1977, abandoned" should read --Continuation of Ser. No. 843,166, Oct. 18, 1977, abandoned--

Column 1, line 6, "17" should read --18--.

Column 3, line 23, "1'" should read --1"--.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*